US006124579A

United States Patent [19]

Steinhauser et al.

[11] Patent Number: 6,124,579

[45] Date of Patent: Sep. 26, 2000

[54] MOLDED POLYMER COMPOSITE HEATER

[75] Inventors: Louis P. Steinhauser; A. Konrad Juethner, both of St. Louis, Mo.

[73] Assignee: Watlow Electric Manufacturing, Fenton, Mo.

[21] Appl. No.: 08/944,592

[22] Filed: Oct. 6, 1997

[51] Int. Cl.[7] ..... H05B 3/44

[52] U.S. Cl. ..... 219/544; 392/503; 219/523; 219/546; 338/269; 338/275

[58] Field of Search ..... 219/544, 437, 219/523, 534, 542, 543, 546, 553; 392/497, 502, 503; 338/254, 255, 262, 263, 264, 265, 269, 275

[56] References Cited

U.S. PATENT DOCUMENTS

| | | | |
|---|---|---|---|
| 1,043,922 | 11/1912 | Gold . | |
| 2,146,402 | 2/1939 | Morgan | 219/41 |
| 3,614,386 | 10/1971 | Hepplewhite | 219/312 |
| 3,621,566 | 11/1971 | Welsh | 29/610 |
| 3,683,361 | 8/1972 | Salzwedel | 338/322 |
| 3,860,787 | 1/1975 | Strobach | 219/336 |
| 3,927,300 | 12/1975 | Wada et al. | 219/381 |
| 3,943,328 | 3/1976 | Cunningham | 219/335 |
| 3,952,182 | 4/1976 | Flanders | 219/309 |
| 4,326,121 | 4/1982 | Welsby et al. | 219/523 |
| 4,346,287 | 8/1982 | Desloge | 219/544 |
| 4,436,988 | 3/1984 | Blumenkranz | 219/544 |
| 4,540,479 | 9/1985 | Sakurai et al. | 219/544 |
| 4,633,063 | 12/1986 | Willis | 219/544 |
| 4,687,905 | 8/1987 | Cunningham et al. | 219/336 |
| 4,707,590 | 11/1987 | Lefebvre | 219/523 |
| 5,013,890 | 5/1991 | Gamble | 392/497 |
| 5,129,033 | 7/1992 | Ferrara et al. | 392/447 |
| 5,136,143 | 8/1992 | Kutner et al. | 219/544 |
| 5,155,800 | 10/1992 | Rezabek et al. | 392/503 |
| 5,237,155 | 8/1993 | Hill | 219/544 |
| 5,300,760 | 4/1994 | Batliwalla et al. | 219/544 |
| 5,304,778 | 4/1994 | Dasgupta et al. | 219/544 |
| 5,453,599 | 9/1995 | Hall, Jr. | 219/544 |
| 5,521,357 | 5/1996 | Lock et al. | 219/544 |
| 5,586,214 | 12/1996 | Eckman | 219/544 |
| 5,622,642 | 4/1997 | Edwards et al. | 219/544 |
| 5,804,791 | 9/1998 | Gelus | 219/544 |
| 5,822,675 | 10/1998 | Paquet et al. | 219/544 |

OTHER PUBLICATIONS

Heaters Engineering, Inc.; brochure; Mar. 2, 1995; p. 4.

Ralph E. Wright; Molded Thermosets; unknown; chapters 3 & 4.

*Primary Examiner*—Teresa Walberg
*Assistant Examiner*—Fadi H. Dahbour
*Attorney, Agent, or Firm*—Herzog, Crebs & McGhee, LLP

[57] ABSTRACT

A molded polymer composite heater is shown. The use of transfer molding and compression molding allows for the use of thermoset polymers containing very high levels of reinforcement fillers. These improved materials, in turn create a heater with thermophysical properties superior to the prior art, including higher heat flux levels, thermal conductivity, impact resistance, and maintenance of mechanical properties at high temperatures (~>300° F.). The present invention also allows for wide variety of geometric configurations and the possibility to insert temperature sensors directly in hot zones of the heater.

16 Claims, 3 Drawing Sheets

MOLDED POLYMER COMPOSITE HEATER

FIELD OF THE INVENTION

The present invention relates to electric resistance heaters and more particularly to an electric resistance heater molded from one or more polymer composites.

BACKGROUND OF THE INVENTION

Electric resistance heaters are common place in industry, and generally comprise a resistance wire, through which an electric current is passed, a ceramic core, around which the same wire is disposed, a dielectric ceramic layer, which surrounds the current-carrying core, and a metal alloy sheath to complete the assembly. One form of electric resistance heater, known as a cartridge heater, which is used in a very wide range of applications, has a cylindrical sheath, which has historically been made of corrosion-resistant metal alloys such as stainless steel or incoloy. To enhance thermal performance of the heating element, the above assembly is typically swaged.

More recently, industry has been looking for alternative cartridge heaters that weigh, cost less to produce, that can be designed with greater geometric flexibility, and that can be cost-effectively mass produced while yielding superior thermal and mechanical performance. One solution was proposed in U.S. Pat. No. 5,586,214 to Eckman and jointly assigned to Energy Converters, Inc. of Dallas, Penn. and Rheem Mfg. Co. of New York, N.Y. Eckman discloses an immersion heater, somewhat similar to a cartridge heater in shape, but being hollow and having apertures in the sheath. Instead of being a solid cylinder, the core represents an injection molded polymeric hollow tube onto which a sheath is injection molded. Therefore, the heater does not have a "core" in the traditional sense. The Eckman heater is shown in FIG. 1.

The Eckman heater does have certain advantages over the prior art, such as low weight, low manufacturing cost at high volume, and its high resistance to galvanic corrosion and mineral depositing. Yet the Eckman heater has many limitations which leaves it undesirable for most applications other than low temperature and low heat flux water heating tanks.

This is supported by the limitation of thermoplastic matrices to accept filler medium. In this context, Eckman discloses that the filler level in these polymeric matrices cannot exceed 40% by weight, which correlates with the research results obtained during the development of the present invention.

Providing a solid core (or at least one of substantially greater wall thickness) in the Eckman heater is not as easy as changing the geometry of the polymer, around which the resistance wire is wound. If a core polymer with the same temperature dependent thermal expansion function as the outer polymer is used, the heater will be prone to cracking and failure when energized and brought to operating temperature. Eckman teaches that the outer polymer coating needs to be less than 0.5 inches and ideally less than 0.1 inches, which further sacrifices structural strength. Eckman achieves somewhat higher thermal conductivity and higher possible heat fluxes than would be found in a pure polymer by suggesting the use of carbon, graphite, and metal powder or flakes as an additive. The amount of these additives must be limited though to protect the heater's dielectric strength. Even then, thermal conductivity does not get significantly better than 1.0 W/(m*K).

It is thus an object of the present invention to provide a molded polymer composite heater with a composite filler level of substantially greater than 40%.

It is also an object of the present invention to provide a molded polymer composite heater with improved structural integrity.

It is further an object of the present invention to provide a molded polymer composite heater with greater core thickness up to the extreme where the hollow space in the center of the element vanishes.

It is yet another object of the present invention to provide a molded polymer composite heater with improved thermal performance, namely thermal conductivity and maximum heat flux.

Other objects of the invention will become apparent from the specification described herein below.

SUMMARY OF THE INVENTION

In accordance with the objects listed above, the present invention is a molded polymer composite heater having highly filled polymers, such that the polymers are best suited for either transfer molding or compression molding. Compared to the prior art, which specifically refers to injection molding, the present invention allows for much higher levels of fill. The higher levels of fill, which exceed 50% by weight and may reach as high as 90% by weight, provide polymer compounds with better mechanical properties such as strength and impact resistance, superior thermal properties, such as higher service temperatures, specific heat, and thermal conductivity, as well as improved electrical properties, such as dielectric strength and insulation resistance. The polymer composite core of the heater has lead terminals inserted therein that contact an electrical resistance wire disposed therearound.

The present invention also preferably uses a greater core and sheath thickness up to and including a solid core, which allows for a greater number of geometric variations and the possibility of including additional features in the heater. For instance, sensors may be included at a particular point in the heater, where temperature measurement is most critical, or microchips may be embedded within the heater providing controlling means integrated with the heater.

Thermoset polymers are preferably used, although a few select thermoplastics may be used as well. The polymers are filled with reinforcing additives, which increase viscosity of the raw and processable molding compound. For best results, the reinforcement level should exceed 50%. The structural integrity of thermoplastics diminishes quickly once reinforcement levels exceed 40%, thus the preference toward thermoset polymers which can exceed the 50% reinforcement level.

Different fillers may be used depending upon the particular need of an application. Some applications, will not need as much thermal conductivity, but will require high mechanical strength and impact resistance. Others may require high chemical resistance, low moisture absorption, etc.

The reinforcement filler may be made from a great number of materials, however many applications require good thermal conductivity of the polymer sheath. For such applications, it has been found that ceramic particulate or ceramic whisker fillers, such as magnesium oxide or boron nitride work well, in addition to many forms of carbon. One must be cautious in using carbon reinforcement, because it decreases the dielectric strength of the sheath and core. The present invention incorporates techniques that allow high fill levels (at least 60%) of carbon fibers without significant loss of dielectric strength, but provide good thermal conductivity and excellent mechanical strength.

According to one aspect of the present invention, the solid core is made of a polymer composite, as described above, formed into two interlocking halves. The halves may be made from the same mold, and have a self-mating feature, thus reducing the cost of manufacture.

The complete core will have bores for two or more pins. For power lead pins, the core will have sections that expose the bores, so that a resistance wire may be welded to the pins. Preferably, one exposed point of the power lead pins will be toward an end of the heater distal to where the lead pins emerge from the heater itself. Another exposed point should be proximate to the end where the lead pins emerge from the heater. This allows for a single wound resistance wire, which is desirable over looped (double wound) resistance wires that are more prone to high-potential short circuits.

Over the core, a polymer sheath is added. The sheath is primarily made of the same polymer composite as the core, although the exact composition may vary, particularly when differing coefficients of thermal expansion are desired, for high temperature applications (~>300° F.). Most of the sheath is added by transfer or compression molding. However, for applications requiring a high dielectric strength, an additional thin layer of polymer may be added by dipping, spraying, or screen printing, either the assembled core or the sheathed heater.

BRIEF DESCRIPTION OF THE DRAWINGS

So that the manner in which the above-identified features, advantages, and objects of the present invention are attained and can be understood in detail, a more particular description of the invention, briefly summarized above, may be had by reference to the embodiment thereof which is illustrated in the appended drawings.

It is noted, however, that the appended drawings illustrate only a typical embodiment of this invention and is therefore not to be considered limiting of its scope, for the invention may admit to other equally effective embodiments. Reference the appended drawings, wherein.

DETAILED DESCRIPTION OF THE DRAWINGS

The present invention is an electrical heater made of a polymer composite, which is preferably either transfer molded or compression molded. Prior attempts at producing polymer heaters have always used injection molding, thereby limiting the possible fill levels in the polymer, which in turn has severely hampered commercial uses of polymer heaters in all but the simplest of applications. The present invention may be used in many different applications, in part due to increases in heat flux and mechanical strength.

The use of higher fill levels also allows a wider range in the physical properties of polymer composites, which in turn allows more flexibility in the geometric configuration of the heater. In addition to making stronger, more durable, and higher thermally performing polymer heaters, this allows for the addition of extra features incorporated within the heater itself.

Figure 1:
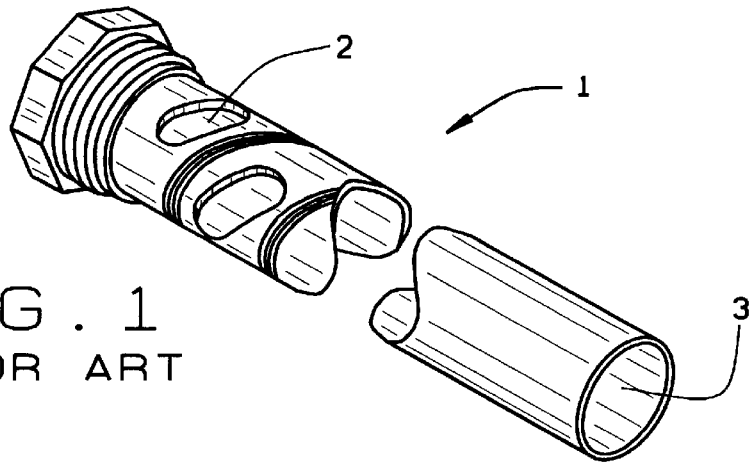
FIG. 1 PRIOR ART
FIG. 1 is an isometric view of a prior art polymer heater as disclosed in U.S. Pat. No. 5,586,214 to Eckman.
Figure 7:
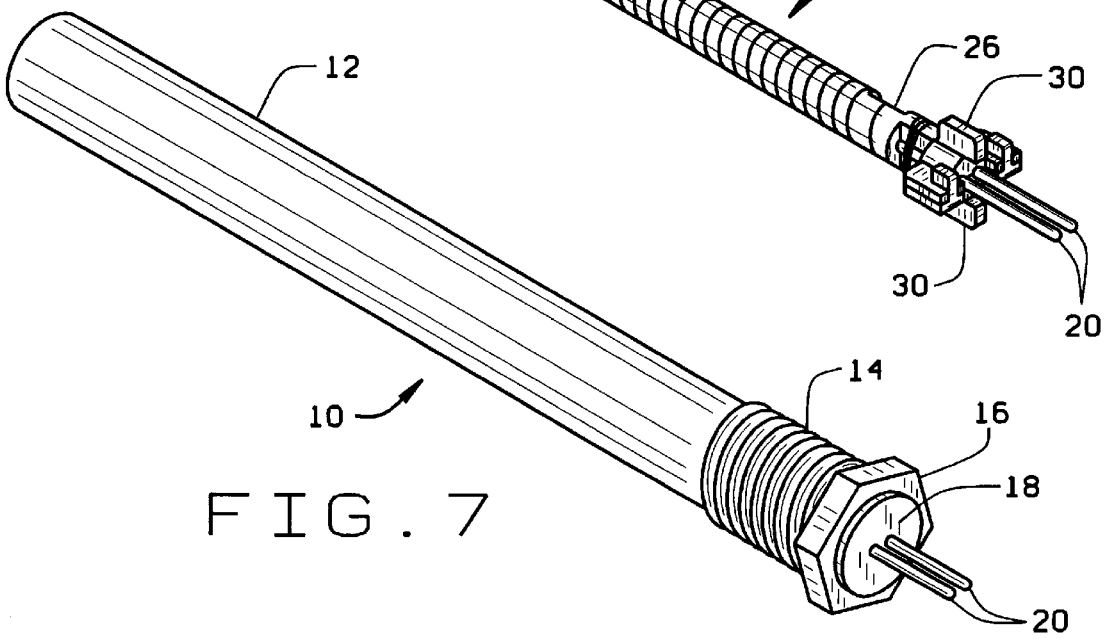
FIG. 7 is an isometric view of a cartridge heater embodiment of the present molded polymer composite heater.

Referring now to FIG. 1, a prior art polymer heater 1 is shown as taught by U.S. Pat. No. 5,586,214 to Eckman. The Eckman heater has a plurality of holes 2 in the sheath of the heater, and a hollow bore 3 in lieu of a core. In contrast, thereto, the preferred embodiment of the present invention is shown as a cylindrical polymer composite heater 10 in FIG. 7. The preferred embodiment includes a sheath 12 incorporating molded threading 14 and a hexagonal flange 16 (both used for mounting). Emerging from the end 18 of the heater 10 proximate to the mounting features 14, 16 are a plurality of power pins 20. The sheath 12 and the mounting features 14, 16 are made of a polymer and formed either by transfer molding or compression molding.

Figure 6:
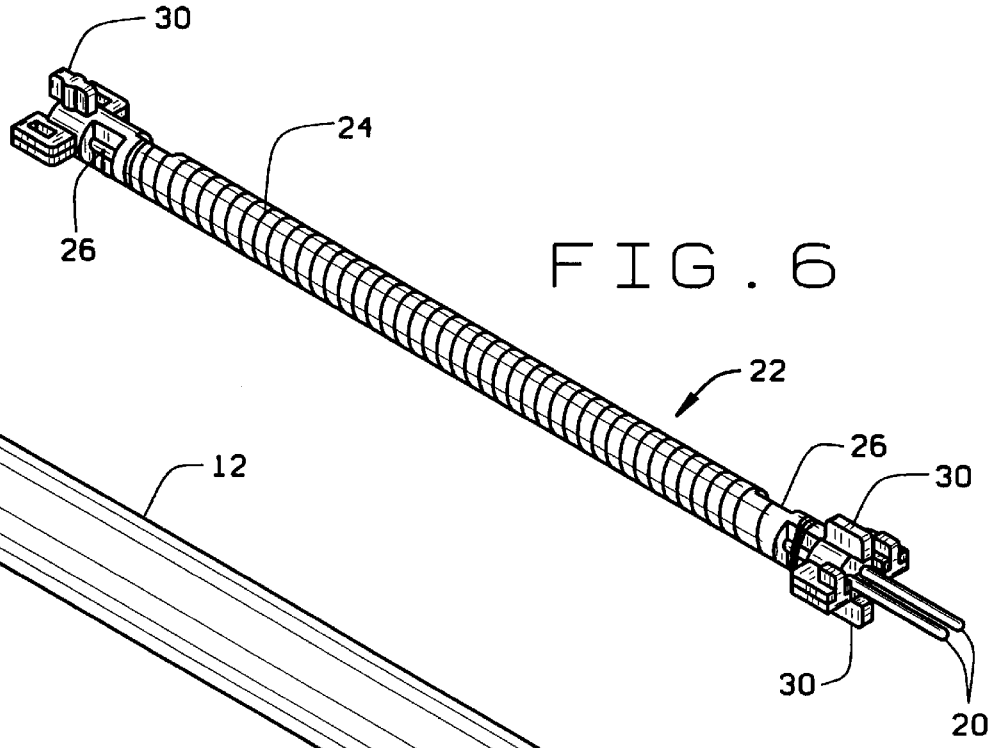
FIG. 6 is an isometric view of a molded polymer composite cylindrical core with a resistance wire disposed therearound and power pins inserted therein.
Figure 2:
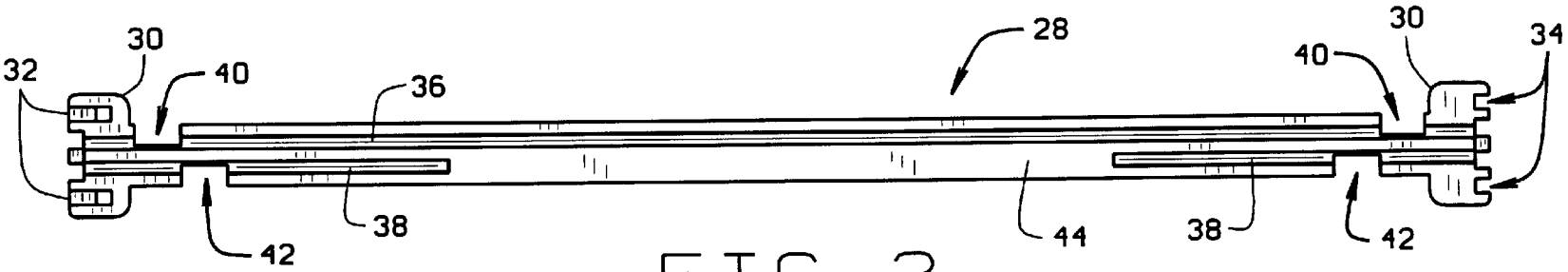
FIG. 2 is a bottom view of a molded polymer composite core semi-cylinder for use in the present heater.
Figure 3:
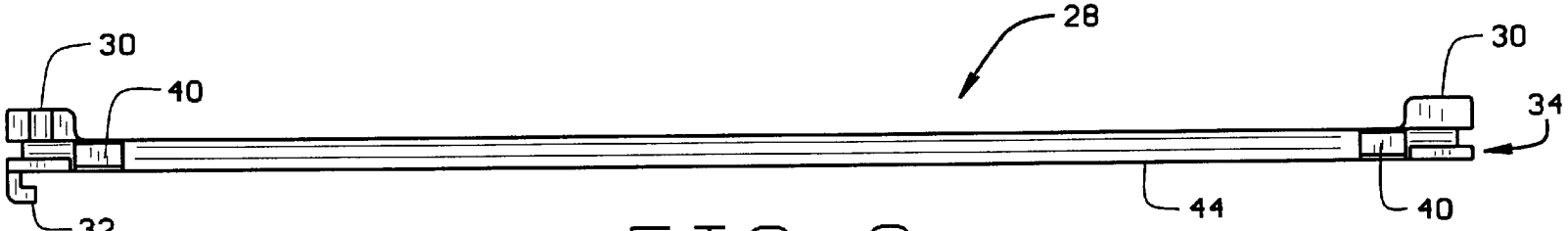
FIG. 3 is a front view of the core semi-cylinder in FIG. 2.
Figure 4:
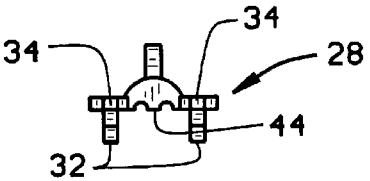
FIG. 4 is a right side view of the core semi-cylinder in FIG. 2.
Figure 5:
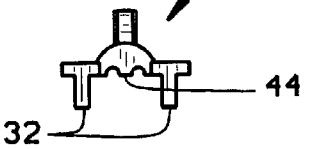
FIG. 5 is a left side view of the core semi-cylinder in FIG. 2.

Hidden beneath the sheath 12 is a completed core 22, shown in FIG. 6. The completed core comprises the power pins 20, a resistance wire 24 welded to the power pins 20 at weld points 26, and optionally formed of two core sections 28 (see also FIGS. 2 and 3). The preferred core sections 28 are identical and substantially cylindrical and semi-circular in cross section except for an end portion 30 on either side.

FIGS. 2–5 show a preferred core section 28. Each preferred core section 28 has one long longitudinal groove 36 that extends the entire length thereof and two short longitudinal grooves 38 running parallel to the long groove 36 that extend an equal distance from either end portion 30, one short groove 38 extending from each end portion 30. The grooves are located on the flat face 44 of the core section 28 (which is semi-circular in cross section). Thus, when the two identical core sections 28 are placed together, abutting at their flat faces 44, the grooves 36, 38 from one core section 28 match up to the grooves 36, 38 from the other core section forming a plurality of bores parallel with the axis of the cylinder.

The core 22 may incorporate a self-mating feature, wherein one end portion 30 of the core section 28 has one or more hooks 32 integrally molded thereon, and the other end portion 30 has an equal number of notches 34 therein. The notches 34 are adapted to receive the hooks 32 located on the other core section 28. This allows the core sections 28 to be cost-effecitvely mass produced with a single mold. It is also possible to form the core by directly insert molding the pins into a one-piece core. This entails literally molding the core around the pins and would allow a less complicated and delicate winding operation more suitable for automation.

As the core sections 28 are coupled together by their respective hooks 32 and notches 34, pins 20 are inserted into the bores formed by grooves 36 and 38. A resistance wire 24, made of any material known in the art, is then wound around the coupled core sections 28 beginning at a welding notch 42 proximal to the extending pin wires, (which gives access to the pin 20 in groove 38) and ending at another welding notch 40 distal to the extending pin wires (which gives access to the pin 20 in groove 36). The resistance wire 24 thus covers a substantial portion of the core 22. It is preferable to wind the resistance wire 24 around the core 22 only as a single strand. Due to the geometric limitations of injection molded polymer heaters, the resistance wire of the prior art had to be wound around the core as a double strand, looping around a hook near the end of the heater distal to the power pins. This prior art configuration increases the probability of high voltage short circuits, which can potentially lead to shorter life spans of the heater or even immediate failure and product rejection. The present single strand does not suffer from the same limitations. The present invention also allows for the resistance wire to be substituted for altogether by a resistive ink, which would be printed on the outside of the core. A typical ink for this use is a cermet polymer resistor series sold by Electro-Science Laboratories, Inc. of King of Prussia, Penn.

Transfer molding and compression molding are known in the art of plastics, and the techniques are disclosed in *Molded Thermosets*, by Ralph E. Wright, which is hereby incorporated by reference. In injection molding, which was used in the prior art, a compacting screw-and-barrel assembly receives the raw granular material from a hopper and melts the same by a heater band assisted screw-and-barrel shearing action. The intermittent reciprocating and rotating motion of the screw pushes the shot through a nozzle and into the mold itself.

In transfer molding, on the other hand, a non-compacting screw pre-plasticates the raw thermoset compound by the use of heater bands. Here, the screw action merely serves the purpose of transporting the material from the hopper to the unreduced barrel exit where the shot is cut and automatically transferred into a cylindrical cavity. A plunger follows thereafter applying great force (~40 tons) to the doughy shot causing tremendous pressure and temperature increase. In turn, the viscosity drops dramatically and the reaction temperature threshold is overshot while the material is pushed through the nozzle into the mold cavity. Another advantage of transfer (and compression) molding is a more effective percolation, which entails thermal bridging of high thermal conductivity particulates by fibers. Yet another advantage of transfer (and compression) molding is that embedded fibers added to the raw polymer maintain their lengths better during these molding processes as compared to injection molding. This is largely due to the fact that injection molding is a more traumatic process than others, causing the fibers to break by imposing intense shearing action thereupon. Additionally, the longer the fibers in the matrices, the more effective the perculation therein. Liquid composite molding ("resin transfer molding"), which is a variation of transfer molding, may also be used in the present invention. In the latter "fiber-friendly" process, the mold cavity is pre-loaded with filler material and the pure polymeric matrix is transferred into the cavity thereafter.

Formable polymers are generally classified as either thermoplastics or thermosets (also known as chemically setting polymers). Thermoplastic materials can be melted and, upon temperature decrease, brought back to solid state. In the solidification process, the polymeric chains contract by folding into one another creating physical bonds as a serving of hot and freshly cooked spaghetti would if one let it sit out to dry. Theoretically, it is possible to impose infinitely many melting/solidification cycles onto the material. In general, thermoplastics are highly impact resistant due to the loose arrangement of polymer chains, yet, allow a higher degree of moisture absorption for the same reason. Revisiting the spaghetti idea, the reader should not find difficult to envision dramatic decay of mechanical properties of thermoplastics at high temperatures.

On the other hand, thermosets can only solidify once whereas subsequent melting is not possible. This curiosity can be explained by the creation of chemical crosslinks between the polymer chains in the chemical reaction solidification process. Not surprisingly, the raw thermoset production material consists of appropriately sized chemical reaction ingredients whose reaction temperature threshold is intentionally exceeded in the molding process. These crosslinks restrict movement of the polymer chains with respect to one another, which translates into a more brittle character compared to thermoplastics. Furthermore, at higher temperatures the same chemical crosslinks maintain mechanical properties. Another advantage of thermosets is that they typically rewet better than thermoplastics. That is to say, before the thermosets have completely cured, more thermoset polymer may be molded thereover, and the bond between the two layers will be strong and less permeable as chemical crosslinks will form across the layer boundary.

As disclosed by Wright, most thermoset plastics are not suitable for injection molding due to high viscosity. Injection molding also limits the amount of reinforcement that can be contained within the polymer composite to no greater than approximately 40% by weight. Fill levels much beyond 40% by weight yield plastics that are too viscous to injection mold when using thermosets (thermoplastics begin to lose structural integrity with fill levels much beyond 40% by weight). Furthermore, the converse is also true that with many plastics, fill levels much below 40% by weight yield a composite that is not viscous enough to transfer mold. The inventors of the present invention have discovered it is not until fill levels within thermoset polymer composites exceed 50% by weight that thermophysical properties are drastically improved. They have also discovered that thermosets in general provide better thermophysical properties for heaters than thermoplastics, particularly once fill levels exceed 50% by weight due to significantly better impact resistance and maintenance of mechanical properties at higher temperatures. Thermoset plastics with high fill levels, as a general rule, are not well suited for injection molding, hence the present invention uses transfer or compression molding.

Thermosets can also accept higher fill levels overall than thermoplastics. As already mentioned, thermoplastic polymers lose structural integrity if filled beyond 40% by weight. Thermosets, on the other hand, can accept fill levels as high as 90% by weight.

The present invention also yields a better heater by using high performance reinforcements. Specific reinforcing fillers provide better thermal conductivity than the fillers used in prior art polymer heaters. Eckman teaches the use of a few thermally conductive materials, such as graphite or metal powder, but specifically warns against excessive use of such fillers, because of loss in dielectric strength of the heater. This limitation may be overcome by the use of an intermediate dielectric layer (not shown) between the resistance wire 24 and the outer sheath 12. The dielectric layer is made of a polymer similar to the rest of the heater, however lacking a reinforcing filler. Dielectric inks from Electro-Science Laboratories, Inc. are well-suited for this purpose. This moots any concern over the dielectric strength of the outer sheath 12. To maximize the efficiency and thermal conductivity of the heater, the intermediate dielectric layer should by ultra thin, approximately 100 microns in thickness, however thicknesses up to 1 millimeter may also be suitable for the present invention. This may be applied to the core by implementing a dipping, spraying, or screen printing operation before over molding the outer sheath 12.

Another method of increasing thermal conductivity is by using carbon fibers as a reinforcing filler. Carbon fibers significantly improve the thermophysical properties of the heater, but they conduct thermal energy much better in their longitudinal, rather than their transverse direction. However, because the fibers behave like logs during the molding, aligning themselves in the direction of the mold flow, their natural tendency is to end up parallel to the heater surface (perpendicular to the heat flux). The desired orientation may be obtained by applying an electric field to the mold flow during manufacturing. The power pins 20 may act as one electrode, and the mold itself may act as the other.

Other desirable fillers that have been found are magnesium oxide (MgO), aluminum nitride (AIN), and boron nitride (BN). The inventors have found by means of the laser flash method (ASTM E1461), in the specific application of which all measured quantities are directly traceable to National Bureau of Standards ("NBS") standards, that such fillers provide thermal conductivity well in excess of 2.0 W/(m*K), and close to 5.0 W/(m*K). On the other hand, it is highly unlikely that the prior art polymer heaters, such as disclosed in the Eckman patent, could ever significantly exceed 1.0 W/(m*K) using the same standard.

Desirable polymer bases for the composite consist of allyls, aminos, epoxies, phenolics, silicones, and thermoset polyesters. The desired reinforcement fillers for the particular heater are selected and added to the base polymer before transfer (or compression) molding.

To use a solid core 22 for high temperature applications, it is likely necessary to offset the coefficient of thermal expansion ("CTE") for the sheath material from the CTE of the core material. This is due to the fact that core material will naturally be hotter than the sheath material. The CTE for the sheath material must be matched (fall within a specific range) to the temperature of a particular application and the CTE of the core material. The CTE of the materials may be adjusted by controlling the filler levels. For example, higher filler levels in the core material can counter the expansion mismatch. Another example of changing the CTE of the core to overcome mismatching, is the use of reinforcing fillers in the core which have lower CTEs than the reinforcing fillers used in the sheath material.

The improved thermophysical properties of the materials used in the present invention, combined with the ability to use solid cores, allows for the heaters to withstand significantly higher temperatures and heat flux levels than those allowed by the prior art. The prior art, using thermoplastic polymers, could not be heated much beyond 180° F. Prototypes of the present invention heaters have been measured at 400° F. (with a core temp of 470° F.), and it is conceivable that temperatures as high as 750° F. would be possible with the selection of the correct fillers and filler levels. The present invention prototypes have managed heat flux levels of 6 W/in$^2$ in natural convection air, and 30 W/in$^2$ in forced convection fluids.

One thermoset composite that has been found to be suitable for the present invention is sold as AB1000F by Cuyahoga Plastics of Cleveland, Ohio. After molding, the resulting heater can withstand continuous operation of up to 1000° F. without losing physical integrity even though the organic substance burns off by 750° F.

Figure 8:
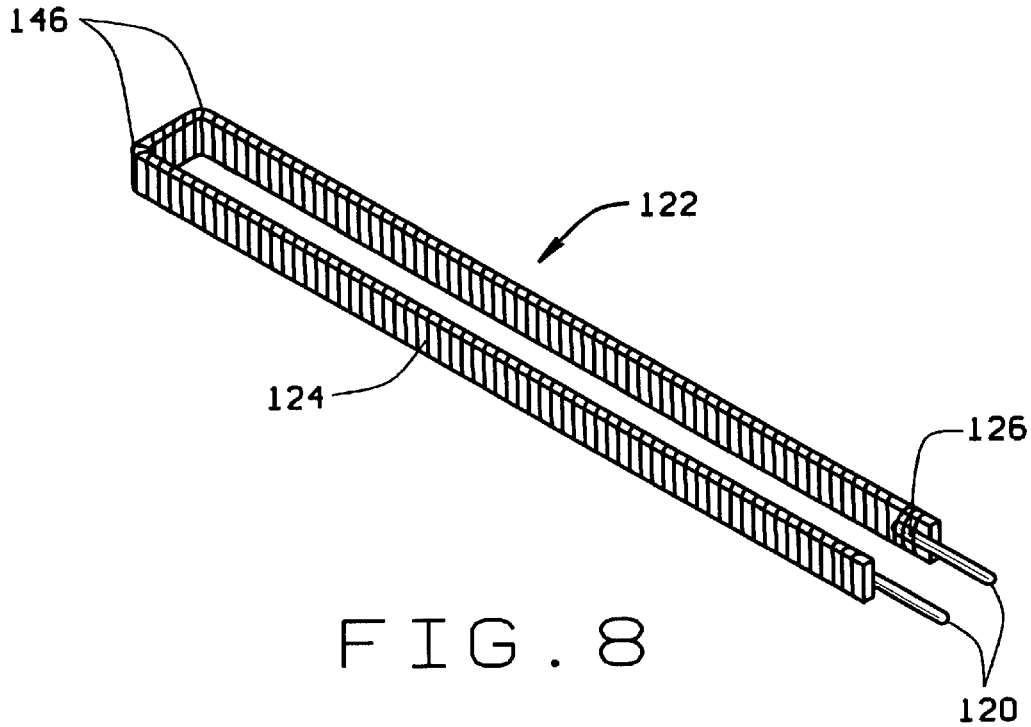
FIG. 8 is an isometric view of a molded polymer composite bent, flat core with a resistance wire disposed therearound and power pins disposed therein.
Figure 9:
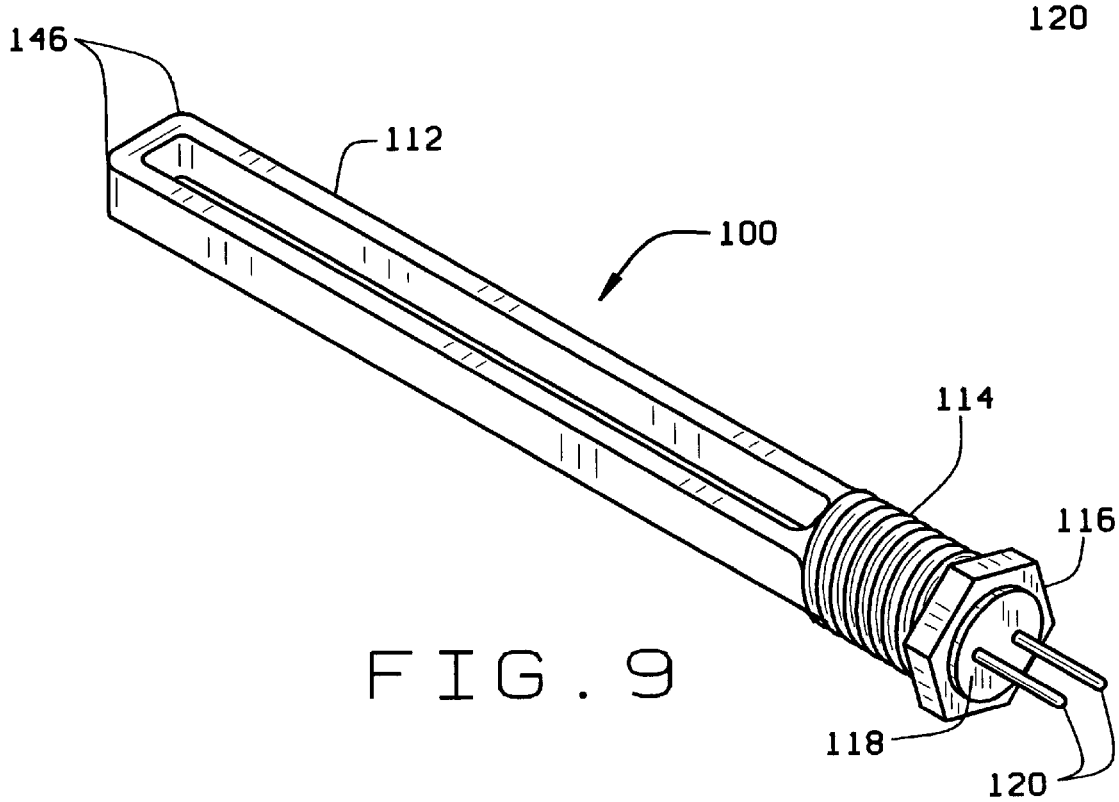
FIG. 9 is an isometric view of a flat-element immersion heater embodiment of the present molded polymer composite heater.

Another benefit of the present invention is the ability to be used in a wide variety of geometric configurations. Differently shaped heaters work better for different applications. For example, flattened heaters provide better convective heat transfer when oriented vertically, than do cylindrical heaters. The preferable geometry will be dependent upon the particulars of an application. However, the present invention allows for that flexibility. For example, FIGS. 8 and 9 show a flattened embodiment 100 of the present invention.

The flattened heater 100 has the same mounting features 114, 116 as the cylindrical heater 10. The sheath 112 is the same material. The core 122, however, is transfer or compression molded in a flattened shape with two closely positioned 90° bends 146, resulting in a hair pin turn. The same type of resistance wire 124 is used, which is coupled to power pins 120 at weld points 126. The power pins 120 then emerge from the finished heater 100 through end 118.

The other advantage of the present invention is the ability to mold temperature sensors such as thermocouples directly into the core 22 at any position that is desired. The prior art shows a thermistor located at the very end of the heater (near the mounting position). This is located in a "cold zone." Therefore, the temperature readings obtained are not indicative of the actual temperature of the heater and are further compromised by the generally low thermal conductivity of the polymeric matrix. By placing thermocouples in the core at "hot zones" a true accurate temperature reading may be obtained, which is preferable.

While the foregoing is directed to the preferred embodiments of the present invention, other and further embodiments of the invention may be devised without departing from the basic scope thereof, and the scope thereof is determined by the claims which follow.

What is claimed is:

1. A molded polymer composite heater comprising:

a polymer composite core;

an electrically conductive heating element disposed about said core, said heating element having two ends adapted to receive an electric current; and a sheath surrounding said heating element, said sheath comprising a polymer composite containing greater than 50% by weight of a thermally conductive filler such that said sheath can withstand a continuous heat flux of 3 watts per square inch in natural air convection.

2. The molded polymer composite heater of claim 1, wherein said thermally conductive filler is a ceramic selected from the group comprising magnesium oxide, aluminum nitride, aluminum oxide, and boron nitride.

3. The molded polymer composite heater of claim 1, wherein said thermally conductive filler comprises carbon fibers.

4. The molded polymer composite heater of claim 3, wherein said carbon fibers are predominantly oriented parallel to the axis of said core.

5. The molded polymer composite heater of claim 3, wherein said carbon fibers are predominantly oriented perpendicular to the axis of said core.

6. The molded polymer composite heater of claim 5, further comprising a dielectric layer disposed between said heating element and said sheath, said dielectric layer being less than 1 millimeter in thickness.

7. The molded polymer composite heater of claim 6, wherein said dielectric layer is less than 100 microns in thickness.

8. The molded polymer composite heater of claim 7, wherein said core is solid.

9. A molded polymer composite heater comprising:

a solid polymer composite core having a first coefficient of thermal expansion;

an electrically conductive heating element disposed about said solid polymer core, said heating element having two ends adapted to receive an electrical current; and a polymer composite sheath surrounding said heating element and having a second coefficient of thermal expansion, said second coefficient of thermal expansion being higher than said first coefficient of thermal expansion.

10. The molded polymer composite heater of claim 1, further comprising a reinforcing filler dispersed throughout said polymer composite core and said polymer composite sheath.

11. The molded polymer composite heater of claim 2, wherein said polymer composite core contains a higher loading of said reinforcing filler by weight than said polymer composite sheath.

12. The molded polymer composite heater of claim 1, further comprising a first reinforcing filler dispersed throughout said polymer composite core; a second reinforcing filler dispersed throughout said polymer composite sheath; and wherein said first reinforcing filler has a lower coefficient of thermal expansion than said second reinforcing filler.

13. The molded polymer composite heater of claim 12, wherein said first reinforcing filler is silica.

14. The molded polymer composite heater of claim 1, wherein said polymer composite core comprises a pair of core sections, each of said core sections being cylindrical with a semi-circular cross-section and adapted to couple to one another to form a cylindrical core with a circular cross-section.

15. The molded polymer composite heater of claim 14, wherein said core sections are self-mating, each said core section being made from the same mold and including one or more hooks at a first end and an equal number of slots at a second end, said slots on each said core section adapted to receive said hooks on the opposite said core section.

16. The molded polymer composite heater of claim 9, wherein said polymer composite core includes a plurality of bores adapted to receive a plurality of terminal leads, and a plurality of notches exposing sections of said terminal leads.

* * * * *